US007870708B2

(12) United States Patent
Borchardt et al.

(10) Patent No.: US 7,870,708 B2
(45) Date of Patent: Jan. 18, 2011

(54) DEVICE AND METHOD FOR EVACUATING A STORAGE BAG

(75) Inventors: Michael G. Borchardt, Naperville, IL (US); Danny Sanchez, Evanston, IL (US)

(73) Assignee: The Glad Products Company, Oakland, CA (US)

( * ) Notice: Subject to any disclaimer, the term of this patent is extended or adjusted under 35 U.S.C. 154(b) by 198 days.

(21) Appl. No.: 12/298,701

(22) PCT Filed: Apr. 17, 2007

(86) PCT No.: PCT/US2007/066776

§ 371 (c)(1),
(2), (4) Date: Oct. 27, 2008

(87) PCT Pub. No.: WO2007/143282

PCT Pub. Date: Dec. 13, 2007

(65) Prior Publication Data

US 2009/0229225 A1 Sep. 17, 2009

(51) Int. Cl.
*B65B 31/00* (2006.01)

(52) U.S. Cl. ..... 53/510; 53/512; 53/432

(58) Field of Classification Search ..... 53/510, 53/512, 133.4, 136.5, 136.1, 139.2, 432, 53/434

See application file for complete search history.

(56) References Cited

U.S. PATENT DOCUMENTS

| | | | | |
|---|---|---|---|---|
| 5,228,271 | A | 7/1993 | Wallace | |
| 5,332,095 | A * | 7/1994 | Wu | 206/524.8 |
| 5,873,217 | A | 2/1999 | Smith | |
| 6,106,449 | A | 8/2000 | Wynne | |
| 6,256,968 | B1 | 7/2001 | Kristen | |
| 6,604,634 | B2 * | 8/2003 | Su | 206/524.8 |
| 6,694,710 | B2 | 2/2004 | Wang | |
| 7,197,861 | B2 | 4/2007 | Higer et al. | |
| 7,578,320 | B2 * | 8/2009 | Borchardt | 141/7 |
| 2008/0190512 | A1 * | 8/2008 | Borchardt | 141/8 |
| 2009/0290817 | A1 * | 11/2009 | Borchardt | 383/63 |

* cited by examiner

*Primary Examiner*—Sameh H. Tawfik
(74) *Attorney, Agent, or Firm*—David Peterson

(57) ABSTRACT

A storage system for storing and preserving food items or the like includes a sealable storage bag having attached to it a one-way valve element that communicates with the interior volume of the storage bag. The system also includes an evacuation device that can be positioned over the one-way valve element to evacuate air entrapped in the interior volume via the valve element. To avoid possible damage to the storage bag, the valve element, or the stored food items, the evacuation device is configured to have a maximum evacuation pressure of 6 pounds per square inch absolute or greater. In an embodiment, to control the maximum evacuation pressure of the evacuation device, the evacuation device can include a pressure control feature which in further embodiments may be pressure activated or user selectable.

2 Claims, 7 Drawing Sheets

FIG. 7
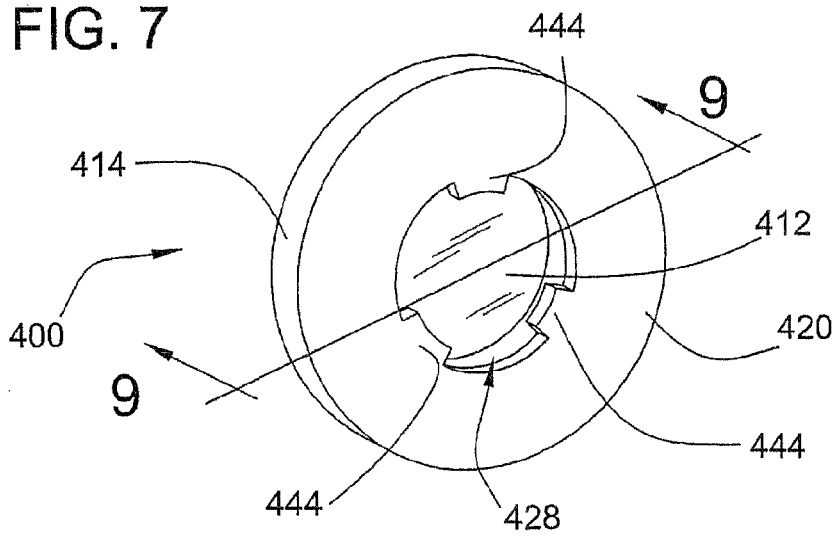
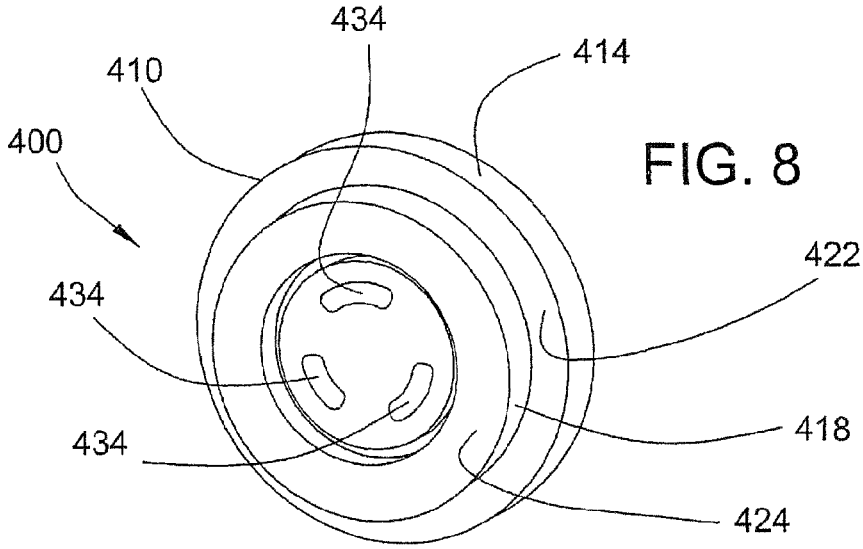
FIG. 8
FIG. 9
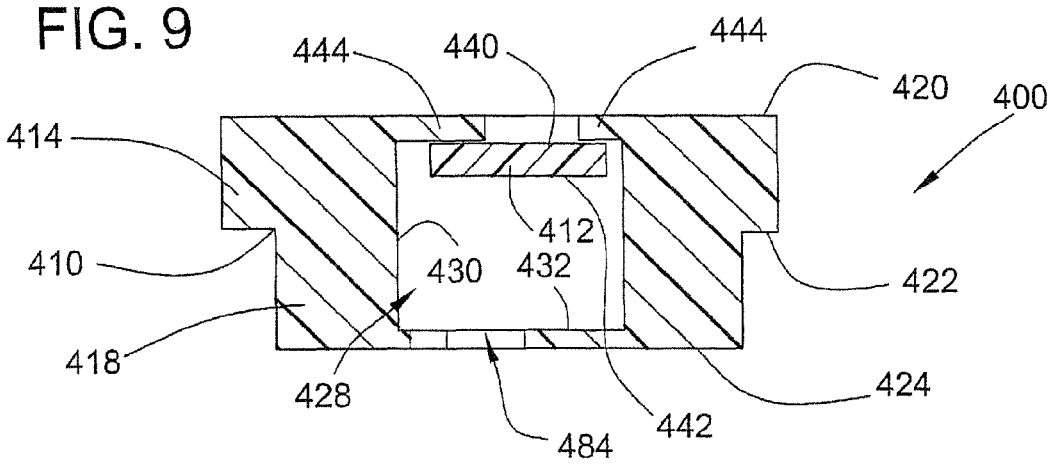

DEVICE AND METHOD FOR EVACUATING A STORAGE BAG

BACKGROUND OF THE INVENTION

Storage bags are commonly used for a variety of purposes such as storing food items. Such storage bags are typically made from a flexible, thermoplastic web material that is configured to provide an interior volume into which food items can be inserted. To preserve the inserted food, the storage bag may also include a closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, a one-way valve element may communicate with the interior volume. The one-way valve element allows for the evacuation of trapped air while preventing the ingress of air from the surrounding atmosphere into the interior volume. Methods of conveying the entrapped air through the one-way valve element include squeezing the flexible sidewalls to force air through the valve element or utilizing a mechanical evacuation device that can interface with the one-way valve element.

Where an evacuation device is used, the evacuation device typically operates by creating a pressure differential across the one-way valve element causing the valve element to open. Entrapped air can then be drawn from the interior volume through the one-way valve element by the evacuation device and exhausted to the surrounding atmosphere. Once the evacuation device is removed, the pressure differential between the surrounding atmosphere, typically at 14.7 pounds per square inch (PSI), and the interior volume closes the valve element. One problem is that the pressure differential used to open and draw air through the valve element may damage the storage bag. Another problem is that evacuating air from the interior volume may cause the flexible sidewalls to collapse in a manner that can damage the stored items.

BRIEF SUMMARY OF THE INVENTION

The invention provides a system and method for evacuating air from the interior volume of a flexible storage bag via a one-way valve element. The invention includes a handheld evacuation device having a housing to be gripped by a user and further having a nozzle providing an inlet opening to be positioned over the one-way valve element on the storage bag. Enclosed within the housing is an airflow generating unit for drawing air through the inlet opening. The maximum evacuation pressure generated by the airflow generating unit may be about 6 pounds per square inch absolute (PSIA) or greater. By way of reference, absolute pressure refers to the total measurable pressure from zero PSI, with atmospheric pressure at sea level typically being about 14.7 PSI. In various aspects, to assure that the maximum evacuation pressure is about 6 PSIA or greater, the evacuation device may also include a pressure control feature which may be pressure activated or user selectable.

The invention also provides a method of storing food items in a manner that preserves their freshness and appearance. The method includes a flexible storage bag that provides an interior volume and a one-way valve element communicating with the interior volume. The food items are inserted into the interior volume and the opening of the storage bag is sealed closed. A handheld evacuation device is positioned over the one-way valve element. When activated, the evacuation device may exert a maximum evacuation pressure of about 6 PSIA or greater and draws air entrapped in the interior volume through the valve element.

An advantage of the invention is that, by exerting a maximum evacuation pressure of about 6 PSIA or greater, potential damage to the storage bag can be prevented. Another advantage is that evacuation pressure resulting inside the interior volume is approximately 6 PSIA or greater. At this evacuation pressure, it is believed that many foods items can be adequately preserved while at the same time the flexible sidewalls will not be so tightly drawn about the food items so as to damage them or distort their appearance. A further advantage is that evacuating food items to only 6 PSIA or greater avoids or reduces dehydration or the removal of fluids and juices from food items that may occur when evacuating food items to lower pressures. Yet another advantage is that a system that evacuates to about 6 PSIA or greater can be made with less complexity and precision than is required for a system that evacuates foods to a lower pressure. These and other advantages and features of the invention will become apparent from the detailed description and the accompanying drawings.

BRIEF DESCRIPTION OF THE SEVERAL VIEWS OF THE DRAWINGS

FIG. 7 is a front perspective view of an embodiment of a rigid one-way valve element for use with flexible bags of the invention.

FIG. 8 is a rear perspective view of the one-way valve element of FIG. 7.

FIG. 9 is a cross-sectional view through the one-way valve element, as taken along line 9-9 of FIG. 7.

DETAILED DESCRIPTION OF THE EMBODIMENTS

Figure 1:
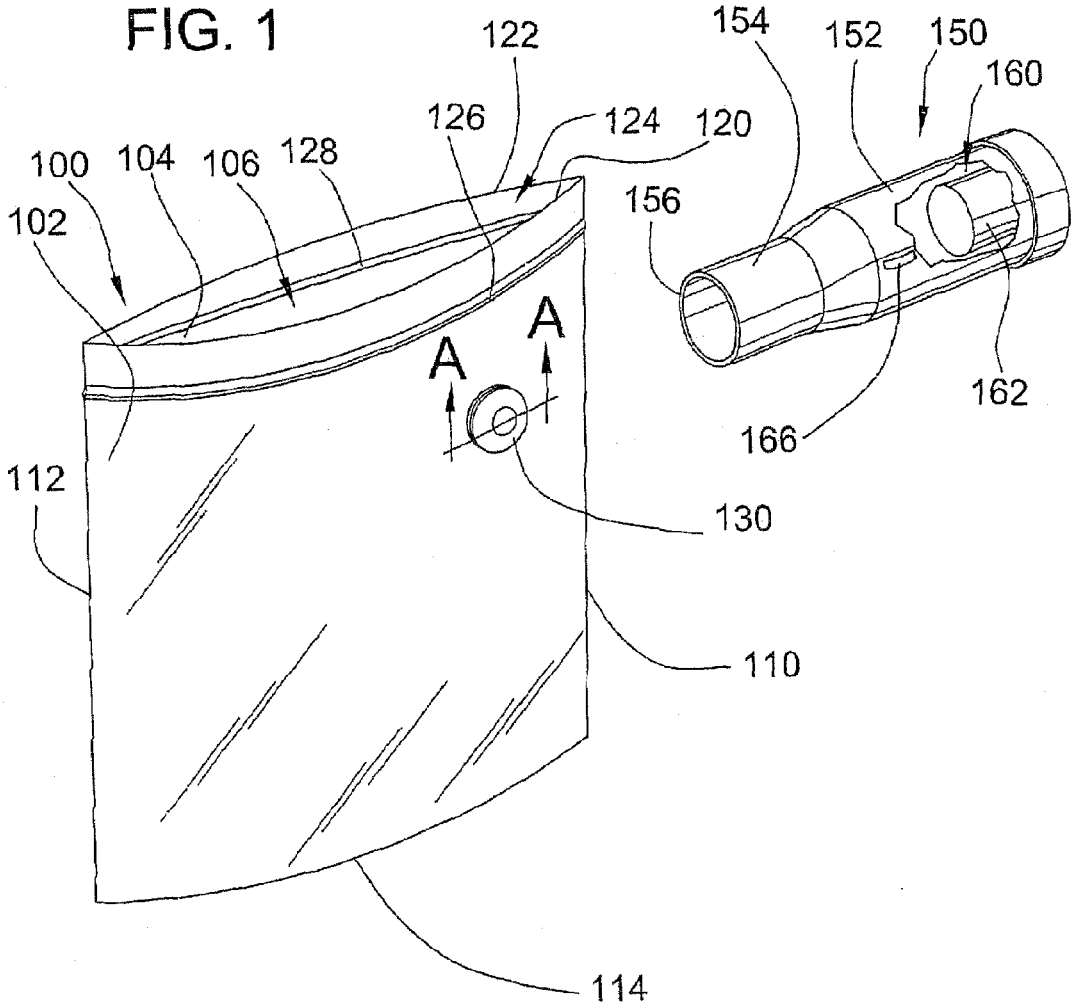
FIG. 1 is a perspective view of the components that may be included in an evacuable storage system including a storage bag having a one-way valve element and a handheld evacuation device configured to operate with an electric motor.

Now referring to the drawings, wherein like reference numbers refer to like elements, there is illustrated in FIG. 1 the various components that can be included in a storage system for the storage and/or preservation of items such as food stuffs. The system includes a flexible storage bag 100 made from a first sidewall 102 and an opposing second sidewall 104 overlying the first sidewall to define an interior volume 106 therebetween. The first and second sidewalls 102, 104 are joined along a first side edge 110, a parallel or non-parallel second side edge 112, and a closed bottom edge 114 that extends between the first and second side edges.

The first and second sidewalls 102, 104 may be made from a flexible or pliable thermoplastic material formed or drawn into a smooth, thin walled sheet. Examples of the thermoplastic material may include high density polyethylene, low density polyethylene, polypropylene, ethylene vinyl acetate, nylon, polyester, polyamide, ethylene vinyl alcohol, and can be formed in single or multiple layers. The thermoplastic material can be transparent, translucent, opaque, or tinted. Furthermore, the material used for the sidewalls can be a gas impermeable material. The sidewalls can have any suitable thickness. For example the film thickness in a first range may have a thickness between 0.0010 to 0.0100 inches (0.0254 to 0.2540 mm). In a second range, the film thickness may be between 0.0020 and 0.0050 inches (0.0508 to 0.1270 mm). In a third range, the film thickness may be between 0.0025 and 0.0035 inches (0.0635 to 0.0889 mm). The sidewalls 102, 104 can be joined along the first and second side edges 110, 112 and bottom edge 114 by any suitable process such as, for example, heat sealing. In one embodiment, the bottom edge may be a folded edge of the sidewalls.

For accessing the interior volume 106, the top edges 120, 122 of the first and second sidewalls 102, 104 opposite the bottom edge 114 remain unjoined to define an opening 124. To seal closed the opening 124, first and second interlocking fastening strips 126, 128 can be attached to the interior surfaces of the respective first and second sidewalls 102, 104. The first and second fastening strips 126, 128 extend generally between the first and second side edges 110, 112 parallel to and spaced below the top edges 120, 122. In other embodiments, the bag 100 can include a movable slider straddling the fastening strips 126, 128 to facilitate occluding and deocculding of the opening 124. In other embodiments, instead of fastening strips, the first and second sidewalls can be configured with pressure sensitive or cold seal adhesives (such as those disclosed in U.S. Pat. No. 6,149,304, herein incorporated by reference in its entirety), heat-sealing, or cling, to seal the open top edge.

To evacuate the bag of latent or entrapped air after the opening has been sealed closed, a one-way valve element 130 may be provided that communicates with the interior volume 106. In the illustrated embodiment, the one-way valve element is shown attached to an upper corner of the first sidewall 102 but in other embodiments could be located at any other suitable location on the storage bag 100. In one embodiment, the one-way valve element 130 is configured to open under an applied pressure differential thereby allowing air from the interior volume 106 to escape and to close after elimination or reduction of the pressure differential thereby preventing the ingress of atmospheric air into the interior volume.

To remove entrapped air from the interior volume 106 via the one-way valve element 130, the system also can include a handheld evacuation device 150. The handheld evacuation device 150 may include an elongated housing 152 that may taper at one end to form a nozzle 154. The housing 152 may be gripped by the hand of a user. The nozzle 154 can be formed to provide a circular inlet opening 156 disposed into the housing 152. The housing 152 including the nozzle 154 can be made from any suitable rigid material such as molded thermoplastic. To enhance engaging the evacuation device 150 with the storage bag 100, in various embodiments a flexible gasket can be included about the rim of the inlet opening 156.

To produce an evacuation pressure or, in other terms, suction at the inlet opening 156, the evacuation device 150 includes an airflow generating unit 160 that is enclosed in the housing 152 and communicates with the nozzle 154. In the embodiment illustrated in FIG. 1, the airflow generating unit 160 includes an electric motor 162. The electric motor 162 may be powered by one or more batteries or by a cord adapted to plug into an electrical socket. To selectively activate the airflow generating unit 162, the evacuation device 150 may include a power switch 166 exposed on the housing 152.

To evacuate the storage bag 100 of entrapped air with the evacuation device 150, the evacuation device is placed adjacent to the storage bag so that the inlet opening 156 is positioned over the one-way valve element 130. When activated, the air flow generating unit 160 removes air from the region of the nozzle 154 thereby producing an evacuation pressure within the nozzle. If the evacuation pressure in the nozzle 154 is lower than the pressure of the entrapped air inside in the sealed interior volume 106, then there is established a pressure differential across the one-way valve element 130. The pressure differential causes the valve element 130 to open, thereby allowing entrapped air in the interior volume 106 to be drawn through the valve element and into the evacuation device 150 for exhaustion to the atmosphere.

In accordance with an aspect of the invention, the maximum evacuation pressure produced by the evacuation device may be about 6 PSIA or greater. For example, the maximum evacuation pressure may be in a range between about 6 PSIA and about 10 PSIA. In one embodiment, the evacuation pressure may be about 7.8 PSIA. To measure the evacuation pressure, an appropriate measuring device can be placed proximate the inlet opening of the nozzle.

An advantage of generating a maximum evacuation pressure of about 6 PSIA or greater is that the interior volume of the storage bag can be evacuated to a similar pressure which is believed sufficient for storing and preserving many food items. Further, it is also believe that the flexible sidewalls under the influence of such an evacuation pressure in the interior volume will not be so tightly drawn about the food items so as to damage the food items or distort their appearance. Also, exerting an evacuation force of about 6 PSIA or greater may avoid potential damage to the flexible storage bag and/or valve element that could occur at lower evacuation pressures.

In the embodiment of the evacuation device illustrated in FIG. 1, the air flow generating unit can be configured so that it can only draw a maximum evacuation pressure of 6 PSIA or greater. However, in other embodiments the evacuation control device can include a pressure control feature. For example, referring to FIG. 2, there is illustrated another embodiment of a hand-operated evacuation device 200 that incorporates a pressure control feature 220 which can be activated by pressure.

As described above, the evacuation device 200 may include a rigid housing 202 that may taper at one end to form a nozzle 204 that can provide a circular inlet opening 206. In the illustrated embodiment, the air flow generating unit 210 enclosed in the housing 202 is configured to operate as a hand-operated pump 212. The hand-operated pump 212 includes a piston 214 reciprocally movable within a piston chamber 216 for moving air through the housing 202 so as to generate an evacuation pressure in the nozzle 204. To move the piston 214 within the chamber 216, the piston is connected to an elongated shaft 218 protruding from the housing 202 opposite the nozzle end 204 and terminating in a handle 219. In other embodiments, the pressure activated pressure control feature 220 can be used with the electrically operated air flow generating unit described above.

Figure 2:
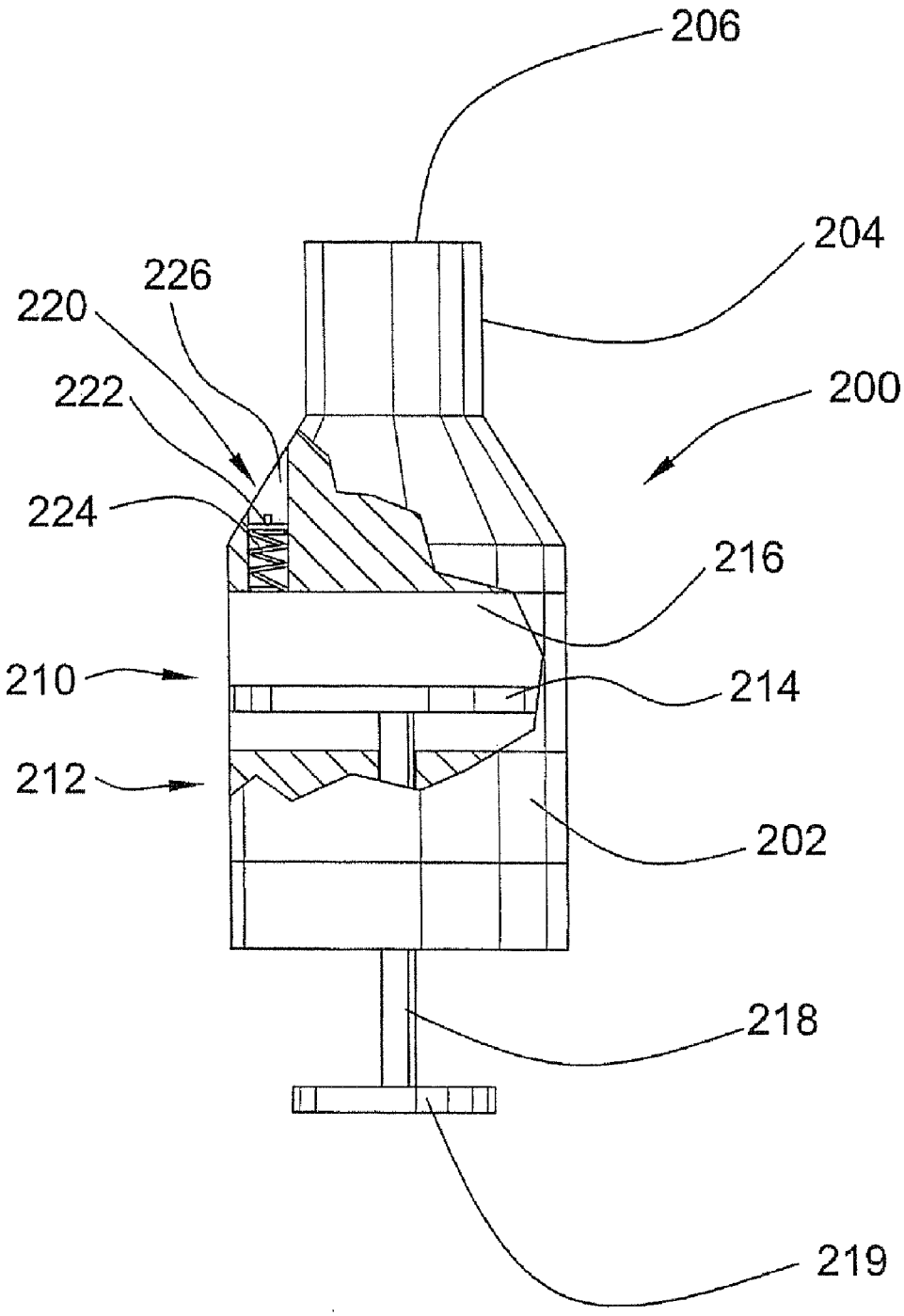
FIG. 2 is a cut-away view showing another embodiment of the handheld evacuation device having a pressure control feature and configured to operate similar to a hand pump.

The pressure activated pressure control feature can be any suitable pressure control feature and can operate with any of variously different evacuation device designs. In the embodiment of FIG. 2, the illustrated pressure control feature 220 is shown as including a movable plunger 222 and a biasing spring 224 placed in a cylindrical bore 226 that communicates through the housing 202 to the atmosphere. The bore 226 is also in communication with the inside of the housing 202. When the airflow generating unit 210 is activated and drawing an evacuation pressure, a pressure differential is established across the pressure control device 220. If, for example, the evacuation pressure is lower than 6 PSIA, the plunger 222 is forced back against the spring 224 within the bore 226. The spring constant of the spring 224 can be such that spring deflects under the effect of the plunger 222 thereby allowing atmospheric air to bleed into the evacuation device and thus limiting the maximum obtainable evacuation pressure.

Figure 3:
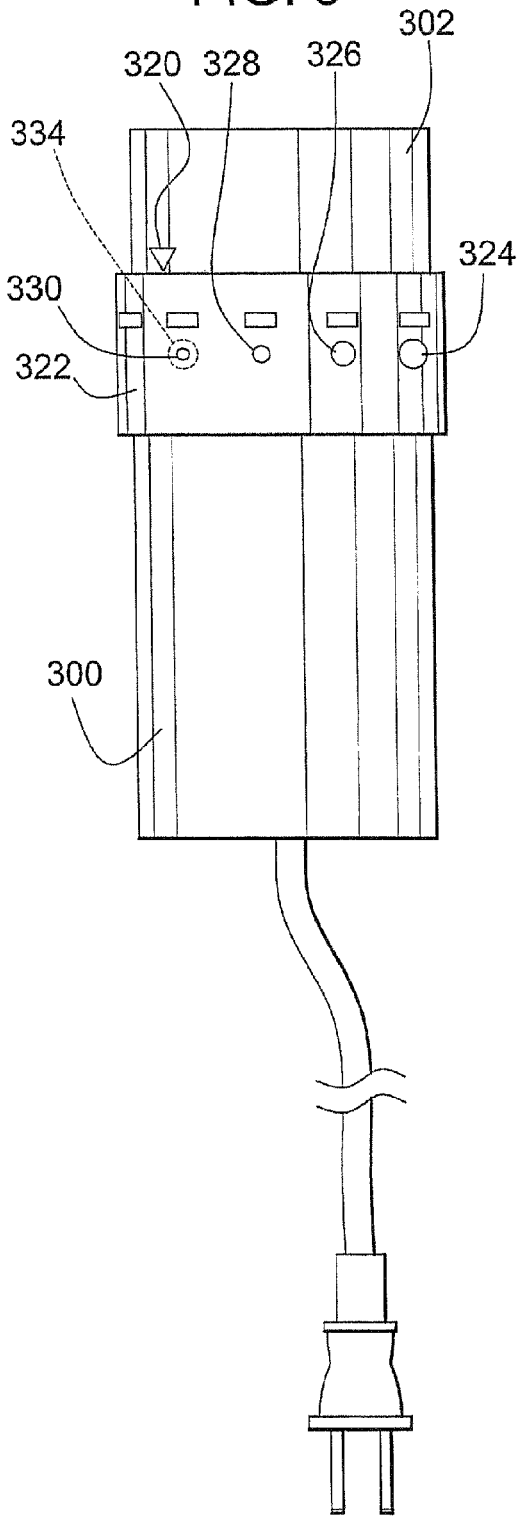
FIG. 3 is side elevational view of another embodiment of a hand held evacuation device having a user selectable pressure control feature including a rotating ring and alignable holes.
Figure 4:
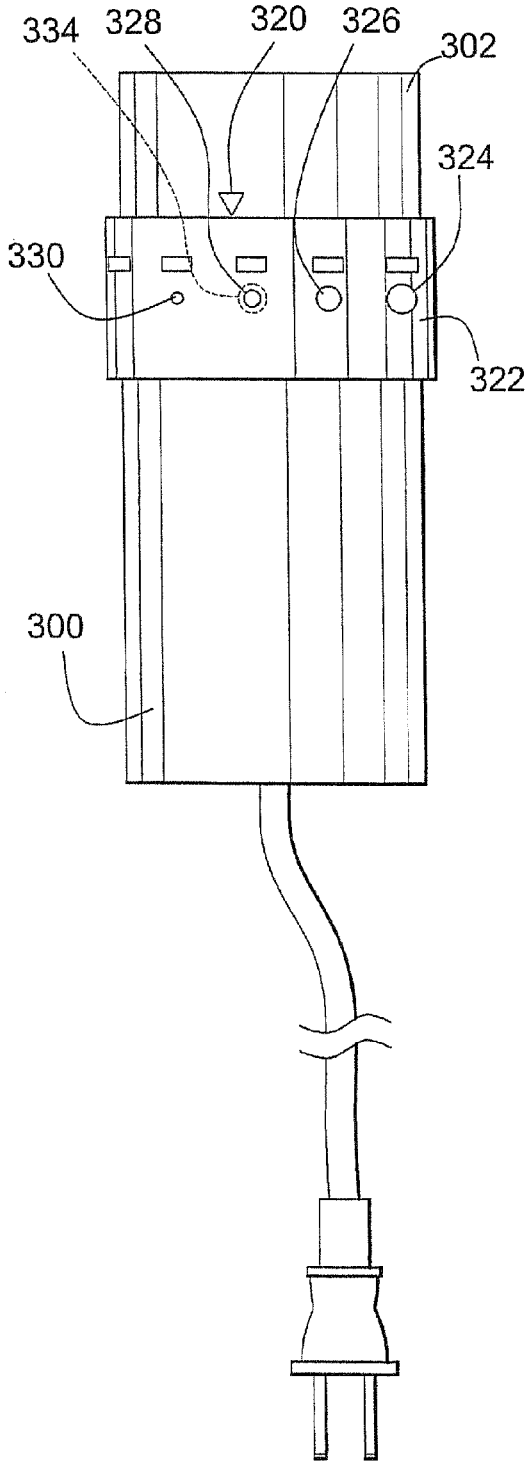
FIG. 4 is a side elevational view of the hand held evacuation device of FIG. 3 showing the pressure control feature in a different position.

Of course, in other embodiments, other types of pressure control features can be used. For example, illustrated in FIGS. 3 and 4, an embodiment of an evacuation device 300 is shown which includes a user selectable pressure control feature 320. The user selectable pressure control feature 320 includes a ring 322 connected to and rotatable with respect the housing 302. Disposed over at least a portion of the circumference of the ring 322 are one or more holes 324, 326, 328, 330. Each successive hole has a larger diameter than the prior hole. For example, hole 324 is larger in diameter than hole 326, hole 326 is larger in diameter than hole 328, and hole 328 is larger in diameter than hole 330.

Disposed through the housing 302 of the evacuation device 300 is an aperture 334 that may have a diameter at least as large as the largest hole 324. The various holes 324, 326, 328, and 330 can be aligned with aperture 334 by rotating the ring 322 with respect to the housing. When so aligned, the aperture and a respective hole allow atmospheric air to bleed into the housing and thereby control the maximum evacuation pressure attainable. Because a number of different sized holes are provided and the ring and aperture can be rotated, the user can select the maximum evacuation pressure attainable. For example, in FIG. 3, aperture 334 is aligned with hole 330. Conversely, referring to FIG. 4, the aperture 334 is aligned with hole 328. Moreover, the holes can be configured to correlate with predetermined maximum evacuation pressures. For instance, hole 324 can correlate with 12 PSIA, hole 326 can correlate with 10 PSIA, hole 328 can correlate with 8 PSIA, and hole 330 can correlate with 6 PSIA.

Figure 5:
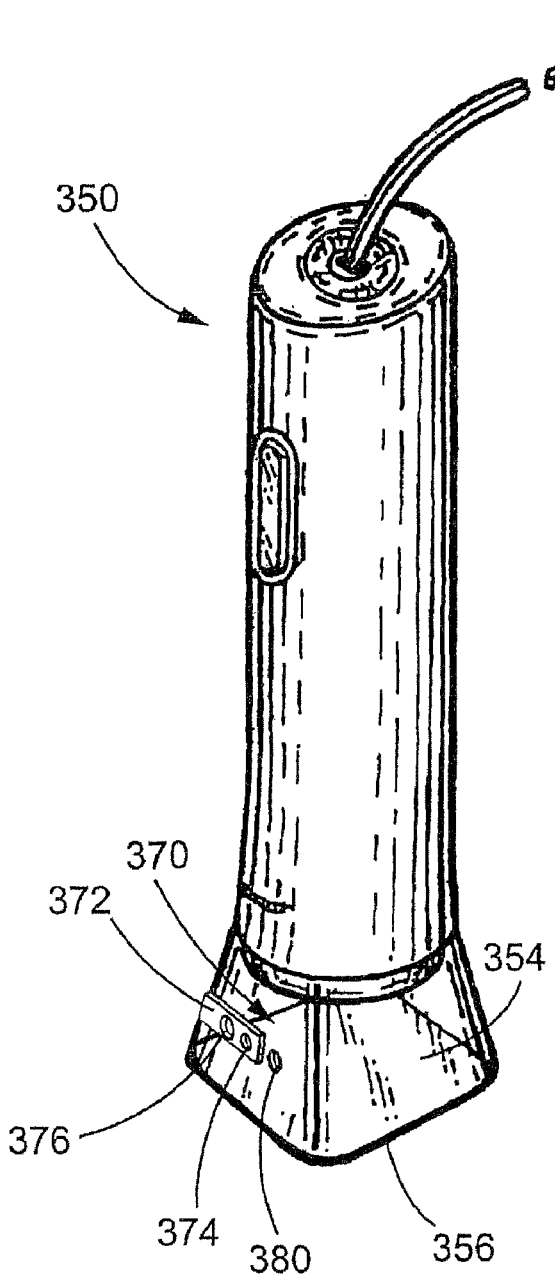
FIG. 5 is a perspective view of another embodiment of a hand held vacuum device having a user selectable pressure control feature including a slide and alignable holes.
Figure 6:
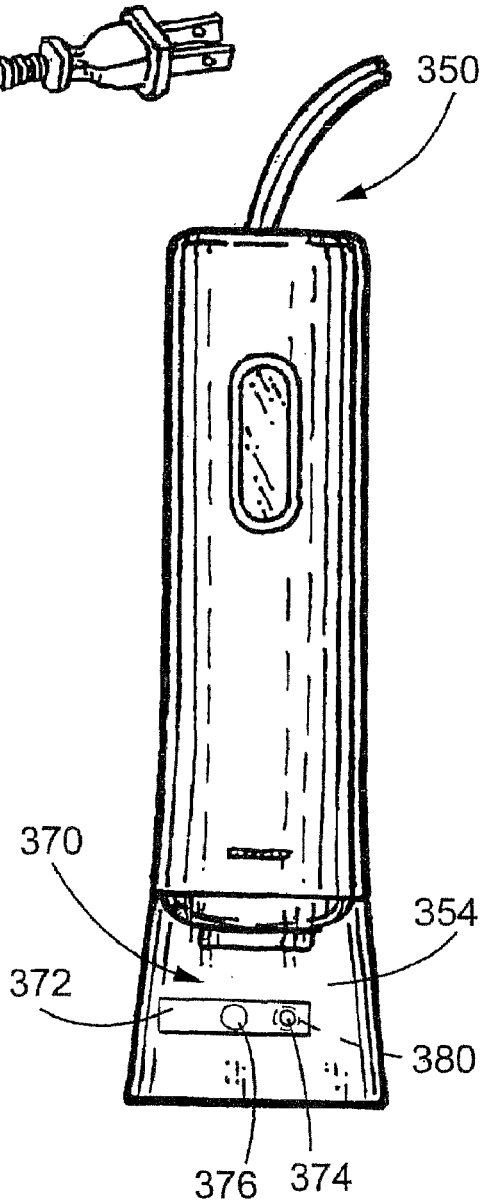
FIG. 6 is a front elevational view of the hand held evacuation device of FIG. 5 showing the pressure control feature in a different position.

Referring to FIGS. 5 and 6, there is illustrated another embodiment of a handheld evacuation device 350 having a user selectable pressure control feature 370. In the illustrated embodiment, the nozzle 354 of the evacuation device tapers at one end to form a generally square inlet opening 356. The user selectable pressure control feature 370 operates on the same principle described above but includes a movable slide 372 connected to and movable with respect to the nozzle 354. A plurality of varying sized holes 374 and 376 are disposed along the length of the slide 372. Disposed through the nozzle 354 is an aperture 380 which may be at least as large as the largest hole 376 in the slide 372. The slide 372 is movable with respect to the nozzle 354 to align the various holes 374, 376 with the aperture 380 and thereby control evacuation pressure in the manner described above.

The one-way valve element used in the evacuation system can be any suitable one-way valve element. For example, referring to FIGS. 7, 8, and 9, the one-way valve element 400 for use with a storage bag of the foregoing type can include a rigid valve body 410 that cooperates with a movable disk 412 to open and close the valve element. The valve body 410 includes a circular flange portion 414 extending between parallel first and second flange faces 420, 422. Concentric to the flange portion 414 and projecting from the second flange face 422 is a circular boss portion 418 which terminates in a planar boss face 424 that is parallel to the first and second flange faces. The circular boss portion 418 is smaller in diameter than the flange portion 414 so that the outermost annular rim of the second flange face 422 remains exposed. The valve body 410 can be made from any suitable material such as a moldable thermoplastic material like nylon, HDPE, high impact polystyrene (HIPS), polycarbonates (PC), and the like.

Disposed concentrically into the valve body 410 is a counter-bore 428. The counter-bore 428 extends from the first flange face 420 part way towards the boss face 424. The counter-bore 428 defines a cylindrical bore wall 430. Because it extends only part way toward the boss face 424, the counter-bore 428 may form within the valve body 410 a planar valve seat 432. To establish fluid communication across the valve body 410, there is disposed through the valve seat 432 at least one aperture 434. In fact, in the illustrated embodiment, a plurality of apertures 434 are arranged concentrically and spaced inwardly from the cylindrical bore wall 430.

To cooperatively accommodate the movable disk 412, the disk is inserted into the counter-bore 428. Accordingly, the disk 412 is preferably smaller in diameter than the counter-bore 428 and has a thickness as measured between a first disk face 440 and a second disk face 442 that is substantially less than the length of the counter-bore 428 between the first flange face 420 and the valve seat 432. To retain the disk 412 within the counter-bore 428, there is formed proximate to the first flange face 420 a plurality of radially inward extending fingers 444. The disk 412 can be made from any suitable material such as, for example, a resilient elastomer.

Referring to FIG. 9, when the disk 412 within the counter-bore 428 is moved adjacent to the fingers 444, the valve element 400 is in its open configuration allowing air to communicate between the first flange face 420 and the boss face 424. However, when the disk 412 is adjacent the valve seat 432 thereby covering the apertures 434, the valve element 400 is in its closed configuration. To assist in sealing the disk 412 over the apertures 434, a sealing liquid can be applied to the valve seat 432. Furthermore, a foam or other resilient member may be placed in the counter-bore 428 to provide a tight fit of the disk 412 and the valve seat 432 in the closed position.

To attach the valve element 400 to the first sidewall, referring to FIG. 9, an adhesive can be applied to the exposed annular rim portion of the second flange face 422. The valve element 400 can then be placed adjacent the exterior surface of the first sidewall with the boss portion 418 being received through the hole disposed into the sidewall and thereby pass into the internal volume. Of course, in other embodiments, adhesive can be placed on other portions of the valve element, such as the first flange face, prior to attachment to the sidewall.

In other embodiments, the one-way valve element can have a different construction. For example, the one-way valve element can be constructed from flexible film materials similar to those disclosed in U.S. Pat. Nos. 2,927,722, 2,946,502, and 2,821,338, all incorporated by reference in their entirety.

Figure 10:
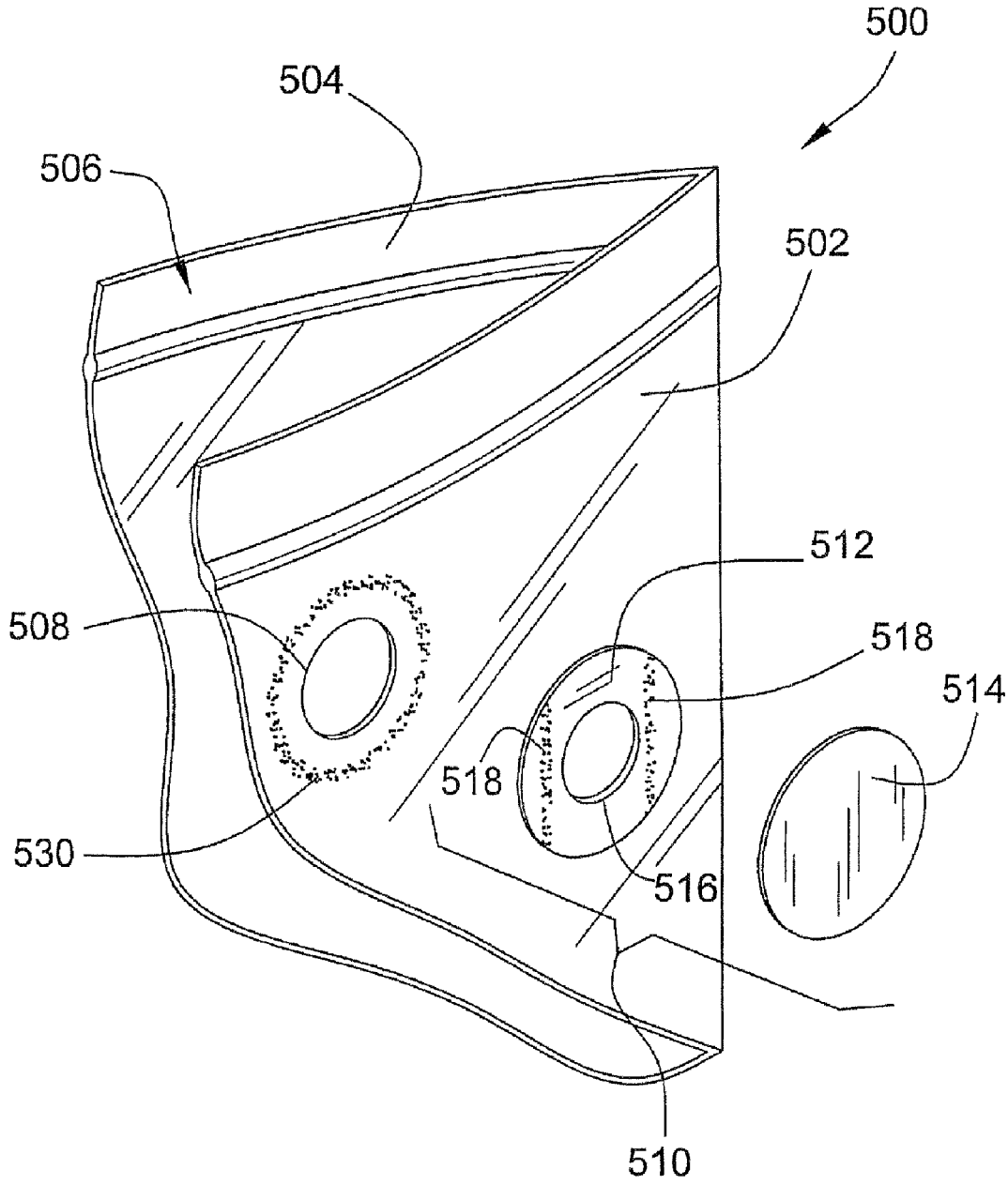
FIG. 10 is an exploded view of another embodiment of the one-way valve element made from pliable layers for attachment to the flexible bag.

As illustrated in FIG. 10, such a flexible one-way valve element 510 made in accordance with this style can include a flexible, circular base layer 512 that cooperates with a correspondingly circular shaped, resilient top layer 514 to open and close the valve element. The top and bottom layers can be made from any suitable material such as, for example, a flexible thermoplastic film. Disposed through the center of the base layer 512 is an aperture 516, thus providing the base layer with an annular shape. The top layer 514 is placed over and adhered to the base layer 512 by two parallel strips of adhesive 518 that extend along either side of the aperture 516, thereby covering the aperture with the top layer and forming a channel. The base layer 512 is then adhered by a ring of adhesive 520 to the flexible bag 500 so as to cover the hole 508 disposed through the first sidewall 502.

As will be appreciated by those of skill in the art, when a pressure differential is applied across the valve element by, for example, placing the nozzle of an evacuation device adjacent the first sidewall 502 about the valve element, the top layer 514 can be partially displaced from the base layer 512 thereby exposing the aperture 516. Air from the interior volume 506 can pass through the hole 508 and aperture 516 and along the channel formed between the adhesive strips 518 where the removed air enters the evacuation device. When the suction force generated by the evacuation device is removed, the resilient top layer 514 will return to its prior configuration covering and sealing the aperture 516. The valve element 510 may also contain a viscous material such as an oil, grease, or lubricant between the two layers in order to prevent air from reentering the bag. In an embodiment, base layer 512 may also be a rigid sheet material.

Figure 11:
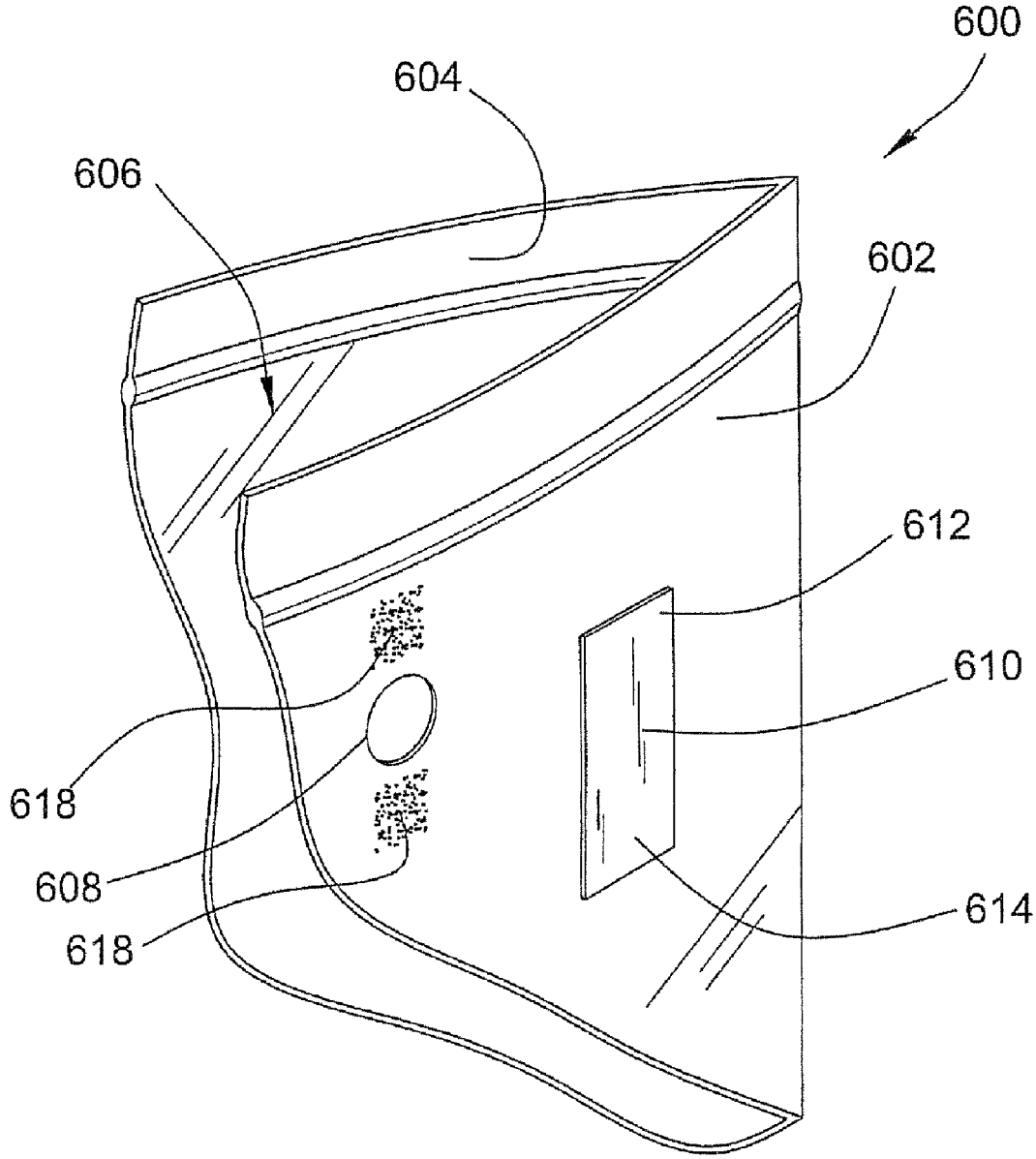
FIG. 11 is an exploded view of another embodiment of the one-way valve element made from a single pliable layer for attachment to the flexible bag.

Illustrated in FIG. 11 is another embodiment of the valve element 610 that can be attached to the flexible plastic bag 600. The valve element 610 is a rectangular piece of flexible thermoplastic film that includes a first end 612 and a second end 614. The valve element 610 is attached to the first sidewall 602 so as to cover and seal a hole 608 disposed through the first sidewall. The valve element 610 can be attached to the sidewall 602 by patches of adhesive 618 placed on either side of the hole 608 so as to correspond to the first and second ends 612, 614. When the nozzle attached to an evacuation device is placed adjacent the first sidewall 602 about the valve element 610, air from the internal volume 606 displaces the flexible valve element 610 so as to unseal the hole 608. After evacuation of air from the internal volume 606, the valve element 610 will again cover and seal the hole 608.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system for storing and preserving food items comprising:

a storage bag, the storage bag including a flexible sidewall providing an interior volume, a sealable opening for accessing the interior volume, and a valve element attached to the flexible sidewall and communicating with the interior volume; and a handheld evacuation device, the evacuation device including a housing adapted for gripping by a user; an air flow generating unit enclosed in the housing, and a nozzle having an inlet opening to create an evacuation pressure;

wherein the evacuation device includes a pressure control feature including a rotating ring with a plurality of holes and an aperture disposed through the housing, the ring rotatable with respect to the housing to align at least one hole with the aperture to allow atmospheric air to bleed into the housing and thereby control the evacuation pressure.

2. The system of claim 1, wherein the plurality of holes includes holes of various sizes.

* * * * *